US006302752B1

(12) United States Patent
Ito et al.

(10) Patent No.: US 6,302,752 B1
(45) Date of Patent: Oct. 16, 2001

(54) INDUCTION SYSTEM FOR WATERCRAFT ENGINE

(75) Inventors: Kazumasa Ito; Akitaka Suzuki; Yasuhiko Henmi, all of Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/338,300

(22) Filed: Jun. 22, 1999

Related U.S. Application Data

(63) Continuation-in-part of application No. 09/280,129, filed on Mar. 26, 1999.

(30) Foreign Application Priority Data

Jul. 29, 1998 (JP) ..... 10-214673

(51) Int. Cl.[7] ..... B63H 21/10
(52) U.S. Cl. ..... 440/88
(58) Field of Search ..... 440/88, 89; 181/214, 181/229, 240, 248, 249, 250, 255; 123/184.53, 184.57, 184.24, 184.25, 184.26

(56) References Cited

U.S. PATENT DOCUMENTS

| | | | | |
|---|---|---|---|---|
| 4,300,488 | * | 11/1981 | Cser | 123/52 M |
| 4,353,211 | * | 10/1982 | Cser et al. | 60/605 |
| 4,538,556 | * | 9/1985 | Takeda | 123/52 MB |
| 4,678,441 | * | 7/1987 | Murase | 440/88 |
| 4,738,229 | * | 4/1988 | Wada et al. | 123/52 MB |
| 4,989,409 | * | 2/1991 | Nakase et al. | 60/321 |
| 5,002,021 | * | 3/1991 | Nakata et al. | 123/52 MB |
| 5,014,816 | * | 5/1991 | Dear et al. | 181/229 |
| 5,088,454 | * | 2/1992 | Washizu et al. | 123/52 MB |
| 5,377,629 | * | 1/1995 | Brackett et al. | 123/184.56 |
| 5,632,239 | * | 5/1997 | Patyi et al. | 123/184.36 |
| 5,647,314 | * | 7/1997 | Matsumura et al. | 123/184.57 |
| 5,735,229 | * | 4/1998 | House et al. | 114/363 |
| 5,827,096 | * | 10/1998 | Mineo | 440/89 |
| 6,009,705 | * | 1/2000 | Arnot et al. | 60/123 |

FOREIGN PATENT DOCUMENTS

| | | | | |
|---|---|---|---|---|
| 1263608 | * | 3/1984 | (FR) | 123/184.57 |
| 357051910 | * | 3/1982 | (JP) | 123/184.57 |
| 359049361 | * | 3/1984 | (JP) | 123/184.57 |
| 402215925 | * | 8/1990 | (JP) | 123/184.57 |
| 402241966 | * | 9/1990 | (JP) | 123/184.57 |
| 403107522 | * | 5/1991 | (JP) | 123/184.57 |

* cited by examiner

*Primary Examiner*—S. Joseph Morano
*Assistant Examiner*—Ajay Vasudeva
(74) *Attorney, Agent, or Firm*—Ernest A. Beutler

(57) ABSTRACT

A number of embodiments of induction systems for watercraft that employ, in addition to the plenum chamber of the air inlet device for the induction system, a further plenum chamber of a predetermined volume that communicates with the induction system plenum chamber for providing silencing and/or tuning effects to improve induction efficiency and silencing. In addition there are disclosed compact intake devices that incorporate plenum chambers for this purpose.

37 Claims, 11 Drawing Sheets

INDUCTION SYSTEM FOR WATERCRAFT ENGINE

CROSS REFERENCE TO RELATED APPLICATION

This application is a continuation in part of our copending application of the same title, Ser. No. 09/280,129, Filed Mar. 26, 1999 and assigned to the assignee hereof

BACKGROUND OF THE INVENTION

This invention relates to a watercraft and particularly a personal watercraft and the induction system therefor.

Personal watercraft are quite popular and their popularity continues to grow. This type of watercraft is generally characterized by the fact that it is designed to be operated by a rider operator who carries no more than two or three additional passengers.

Although these watercraft are quite sporting in nature and are used in a sporting manner, there is an interest in reducing the noise generated by this type of watercraft. One part of the watercraft operational system that can generate noise is the induction system of the engine. For the most part, the induction systems used for this type of watercraft have been designed primarily to ensure adequate air induction and in some instances, some filtration of the inducted air. Little effort has been given, however, to the silencing of the induction system.

It is, therefore, a principal object of this invention to provide improved induction system for a watercraft and particularly a watercraft of the personal type that employs an induction system silencing arrangement.

Obviously, it is necessary for the induction system to be able to ingest adequate air for maximum engine performance. In many instances, the induction systems previously proposed for personal watercraft have not recognized the advantages of using a tuning arrangement on the intake side of the engine. One reason for this is that the space available in the watercraft generally does not afford room for various types of intake tuning systems.

It is, therefore, a still further object of this invention to provide an improved induction system for a watercraft engine that is tuned so as to assist in the induction of air and permit the induction of adequate air for all running conditions.

As another issue, because of the fact that this type of watercraft oftentimes becomes capsized in normal operation, it is also important that the induction system be designed in such a way that water which may be present in the engine compartment will not be drawn into the engine through the induction system.

It is, therefore, a still further object of this invention to provide an improved watercraft induction system wherein the ingestion of water from the engine compartment is substantially precluded.

As should be apparent from the foregoing description, the provision of an induction system to achieve these ends for a personal watercraft also presents significant problems in that such watercraft have relatively little space available for the engine and other running components due to the nature of its construction. Thus, unlike automotive systems where there is a relatively large space available, it is necessary that the induction system be quite compact in nature and nevertheless be able to achieve the foregoing purposes.

It is, therefore, a further, principal object of this invention to provide an improved, compact induction system for a personal watercraft engine.

It is a further object of this invention to provide an improved air inlet device for a personal watercraft engine that will ensure good silencing and tuning of the induction system so as to achieve the aforenoted objects.

It is an even further object of this invention to provide an improved air inlet device for a personal watercraft engine that will achieve these results and yet be simple in construction and low in cost.

SUMMARY OF THE INVENTION

A first feature of this invention is adapted to be embodied in an induction system for the engine of a watercraft which watercraft comprises a hull having an engine compartment. An internal combustion engine having at least one combustion chamber is supported in the engine compartment of the hull. The engine has an output shaft that is coupled to a propulsion device mounted by the hull for propelling the hull through a body of water. The induction system includes means that define a plenum volume of a predetermined volume. An atmospheric air inlet is provided to the plenum chamber and which has an inlet opening that communicates with the engine compartment for drawing air therefrom and an outlet end that communicates with the plenum chamber. A second chamber of a predetermined volume is also provided. The second chamber of a predetermined communicates with the first plenum chamber.

Another feature of the invention is adapted to be embodied in an inlet device that is adapted to be utilized with the induction system of a personal watercraft engine. The inlet device is comprised of an outer housing that defines a main plenum chamber. This main plenum chamber has at least one outlet opening that is adapted to be attached in registry with an intake system of the associated engine for delivering a charge from the main plenum chamber to the engine induction system. At least one atmospheric air inlet opening is formed in the outer housing of the inlet device for delivering an air charge to the main plenum chamber. An auxiliary plenum chamber is formed also at least in part by the outer housing and communicates with the main plenum chamber through a tuning neck.

DETAILED DESCRIPTION OF THE PREFERRED EMBODIMENTS

Figure 1:
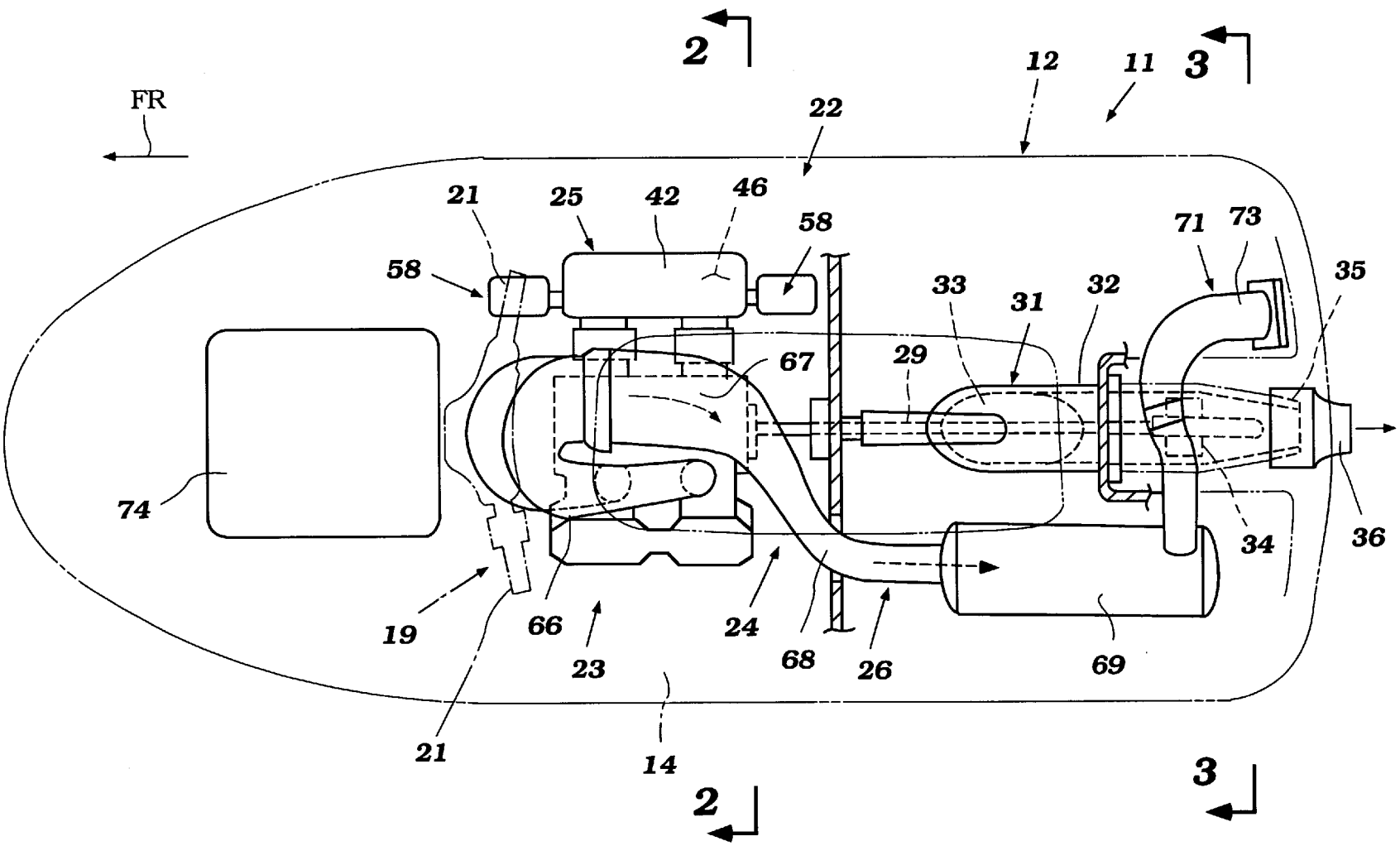
FIG. 1 is a top plan view of a personal watercraft constructed in accordance with a first embodiment of the invention, with the watercraft hull being shown primarily in phantom but with the propulsion system being shown primarily in solid line.
Figure 2:
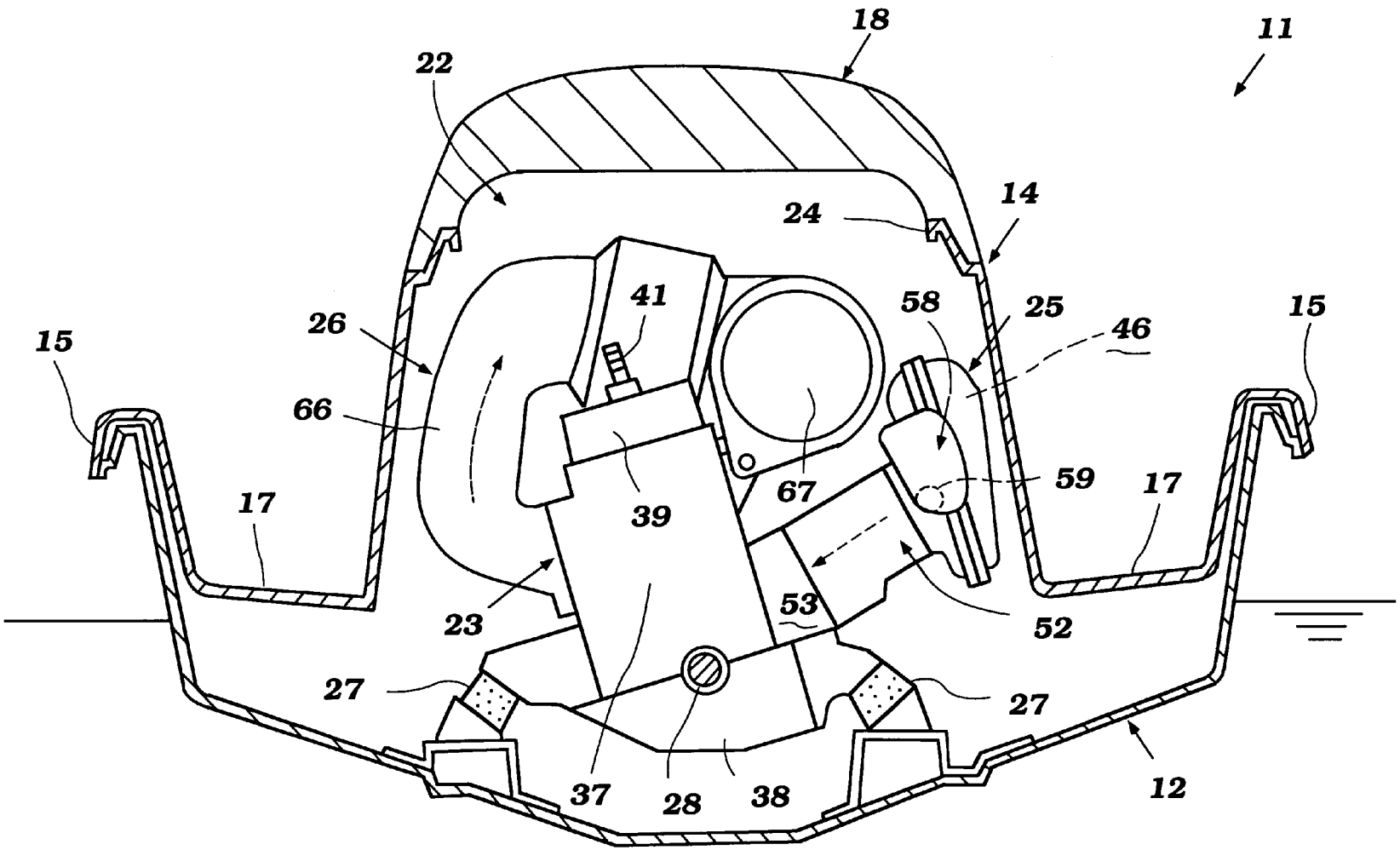
FIG. 2 is an enlarged cross-sectional view taken along the line 2—2 of FIG. 1.
Figure 3:
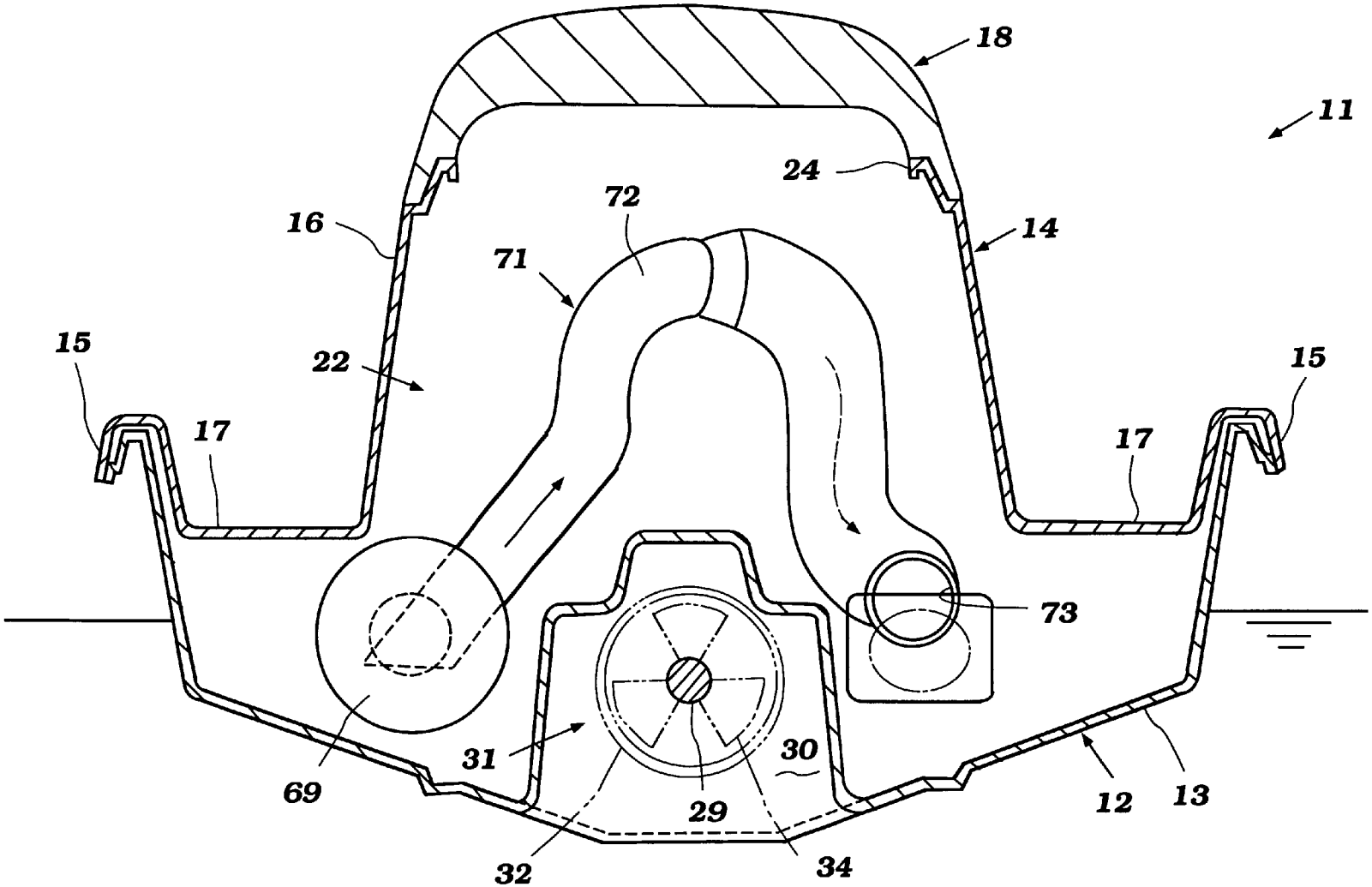
FIG. 3 is an enlarged cross-sectional view taken along the line 3—3 of FIG. 1.

Referring now in detail to the drawings and initially to the embodiment of FIGS. 1–5 and initially, primarily to FIGS. 1–3, a personal watercraft constructed in accordance with this embodiment of the invention identified generally by the reference numeral 11. The personal watercraft 11 is comprised of a hull, indicated generally by the reference numeral 12, which is comprised of a hull under portion 13 and a deck portion 14. These portions are formed primarily from a suitable material such as a molded fiberglass reinforced resin or the like and are secured to each other along a gunnel 15.

The watercraft is provided with a passenger's area which is formed primarily by a raised portion 16 of the deck 14 which is bounded on its opposite sides by foot areas 17 that are disposed below the upper ends of the gunnels 15. A seat 18 is mounted on the upper portion of the raised hull part 16 and is designed so as to accommodate a rider and no more than two or three additional passengers.

This type of watercraft is well known in the art and the specific configuration thus far described should be considered as only exemplary of one of many types of hull configurations with which the invention can be employed.

Forwardly of the seat 18 in the passenger's area there is provided a watercraft control, shown in phantom in FIG. 1 and indicated generally by the reference numeral 19. This control 19 includes a handle bar assembly 21 by which the watercraft may be steered, in a manner which will be described, and also which carries certain controls for the propulsion unit, to be described shortly.

The area between the hull portions 13 and 14 defines an engine compartment, indicated generally by the reference numeral 22, in which a powering internal combustion engine, indicated generally by the reference numeral 23, is positioned. In the illustrated embodiment, the engine 23 is of the two-cylinder, inline type and operates on a two cycle, crankcase compression principle. It will be apparent, however, that certain facets of the engine can be utilized with engines having other cylinder numbers and configurations, as well as engines that operate on a four cycle principle.

The engine 23 is provided primarily under an opening 24 formed in the raised pedestal portion 14 and which is covered by the seat 18. The seat 18 or a portion of it is removable so as to access the engine and the propulsion system for servicing through the opening 24, as will become apparent.

The configuration of the engine 23 and certain of its auxiliaries will be described later in more detail. However, the engine 23 is provided with an induction system, indicated generally by the reference numeral 25, which incorporates the invention and an exhaust system, indicated generally by the reference numeral 26.

The engine 23 is mounted in the hull 12 on a pair of engine mounts 27 (FIG. 2) so that its crankshaft 28 rotates about a longitudinally extending axis which is disposed substantially on the centerline of the hull 12.

This mounting of the engine facilitates coupling of the crankshaft 28 to an impeller shaft 29 of a jet propulsion unit, indicated generally by the reference numeral 31. This jet propulsion unit 31 is mounted in part in a tunnel 32 (FIG. 3) which is formed on the rear under part of the hull portion 13.

This jet propulsion unit 31 has an outer housing assembly 30 which cooperates with the hull portion 13 to define a downwardly facing water inlet opening. Water is drawn through this inlet opening by means of an impeller 34 that is fixed for rotation with the impeller shaft 29 in a suitable manner. This water is then discharged rearwardly through a discharge nozzle portion 35 of the outer housing 32 for providing a propulsive force to the watercraft 11.

A steering nozzle 36 is mounted for steering movement on the discharge nozzle 35 and is controlled by the aforenoted control 19 so as to control the direction of travel of the watercraft 11, in a manner well known in this art.

Referring now primarily to FIGS. 1 and 2, the general construction of the engine 23 will be described. As has been previously noted, the engine 23 is of the two-cylinder, inline type and hence, its cylinder block, indicated at 37, is formed with two longitudinally spaced, generally vertically extending cylinder bores (not shown).

The cylinder block 37 is mounted in the hull 12 so as to be inclined from the vertical at an acute angle as best seen in FIG. 2 so as to provide clearance for the various components while maintaining ease of accessibility for service purposes.

The pistons contained within the cylinder bores are connected to the crankshaft 28 by connecting rods in a conventional manner and, for this reason, these internal components of the engine have not been illustrated nor will they be described further. Those skilled in the art will readily understand how the invention can be practiced with a wide variety of types of engine.

A crankcase member 38 is affixed to the lower end of the cylinder block 37 and forms a crankcase chamber. The induction system 25 delivers the intake charge to the engine 23 through intake ports in a manner that is well known in the art and, for that reason, is not illustrated nor will it be described in any detail.

The charge which is compressed in the crankcase chambers is then transferred to combustion chambers that are formed in part by a cylinder head assembly 39 that is affixed to the upper end of the cylinder block 37. Spark plugs 41 are mounted in the cylinder head assembly 39 for firing a fuel air charge that is formed in any known manner. This charge is then discharged to the atmosphere to the exhaust system 26 as aforenoted.

Figure 4:
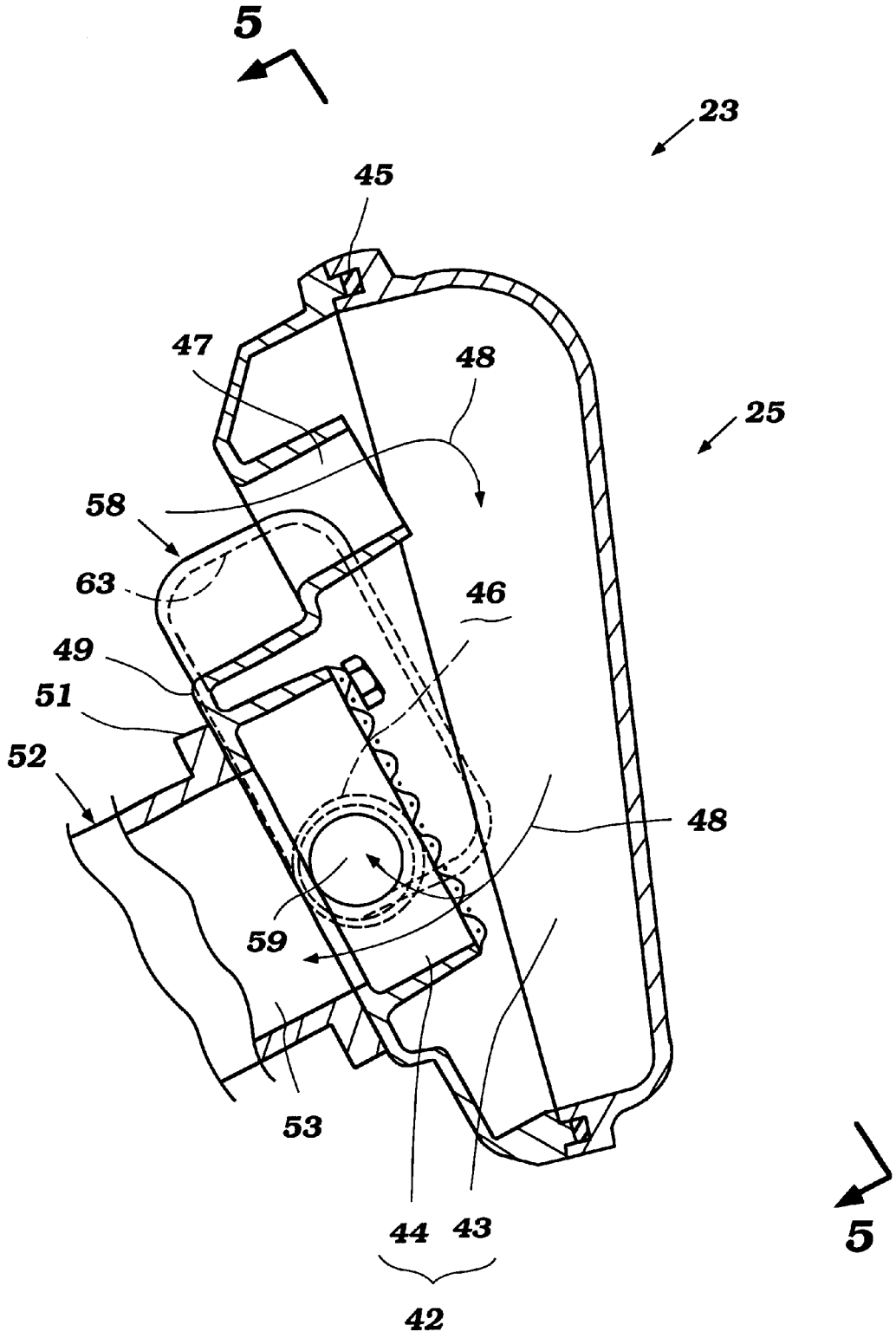
FIG. 4 is an enlarged view looking in the same direction as FIG. 2, but shows the air inlet device associated with the induction system in cross section.
Figure 5:
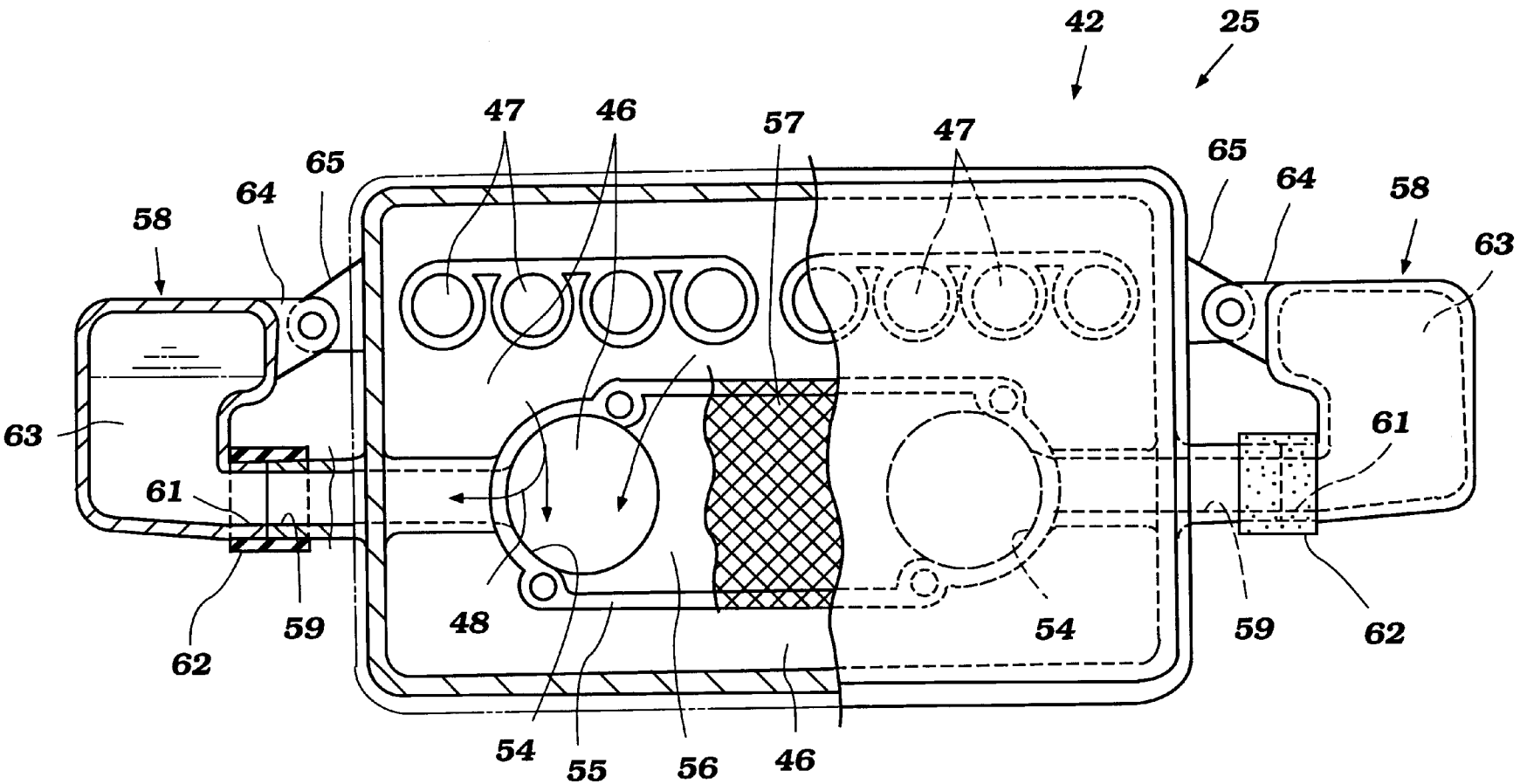
FIG. 5 is a view of the air inlet device looking generally in the direction of the arrows 5—5 in FIG. 4 with a portion broken away and shown in section.

Turning now specifically to the induction system 25, this is illustrated in major part in more detail in FIGS. 4 and 5, although reference may still be had to FIGS. 1 and 2 so as to understand the various components and their relationship. The induction system 25 includes a main plenum chamber forming housing, indicated generally by the reference numeral 42.

This housing may be formed from a suitable material and is comprised of first and second housing parts 43 and 44 that are affixed to each other and which carry a seal 45 around their peripheral edges. The housing part 43 basically has a plain cup-like configuration and cooperates with portions of the housing part 44 so as to define an internal plenum volume, indicated by the reference numeral 46, which has a predetermined fixed volume.

Atmospheric air is delivered to the volume 46 through a plurality of inlet trumpets 47 that are formed in the housing member 44 on a side facing inwardly toward the engine and particularly a portion of the exhaust manifold, as will be described later. In this way, the inducted air flows in the direction indicated by the arrows 48 and will be well protected from picking up any water that may be present in the hull or in the bilge area. It should be noted in this regard that the hull is provided with a suitable ventilating system by which atmospheric air can be admitted for ventilating purposes and also for combustion within the engine.

The housing portion 44 has a surface 49 that is adapted to be affixed in abutting relationship to a flange 51 of throttle bodies 52 which, in turn, communicate with an intake manifold 53 which communicates with the aforenoted intake ports in the crankcase chambers. These throttle bodies 52 define passages 53 that are aligned with and receive air from discharge openings 54 formed in the wall 49 of the member 44.

These discharge openings 54 are surrounded by an upstanding wall 55 so as to define a chamber 56 on the upstream side of the openings 54. A filter screen 57 is mounted on the outer surface of the wall 55 for filtering the air that is inducted before it flows into the engine induction system.

In addition to the plenum chamber 46, there are provided a pair of auxiliary plenum chamber devices, indicated generally by the reference numeral 58, which are mounted in a manner to be described in the fore and aft sides of the housing 42. The housing 42 is formed with a pair of flow passages 59 which extend from the volume area 56 outwardly past the outer walls of the housing member 44. These passages 59 mate with short connecting passageways 61 formed in each of the auxiliary plenum chambers 58. Flexible hoses 62 join the passages 59 and 61.

Each auxiliary plenum chamber 58 defines an internal volume 63 of a predetermined, fixed sizes. Each volume 63 coupled with the passages 61 and 59 forms a Helmholtz resonator. Thus, these devices will act so as to provide not only a silencing function, but can act to augment the intake charge and by tuning these to certain engine speeds can improve the air flow and accordingly, the overall engine performance.

In addition to the support provided by the flexible hoses 62, tabs 64 are formed on the auxiliary plenum chambers 58 which are connected by fasteners to tabs 65 formed on the housing member portion 44.

The exhaust system for the engine 23, which exhaust system is identified, as previously noted, by the reference numeral 26, will now be described by principal reference to FIGS. 1–3. This exhaust system 26 includes an exhaust manifold 66 which is affixed to the side of the cylinder block 37 on the side opposite to the intake system 25. This exhaust manifold 66 has its runners extending upwardly and forwardly to a common collector section which is connected to an expansion chamber device 67 that extends in part over the induction system 25 and which extends generally along in confronting relationship to the inlet openings 47 of the intake device 25. The advantages of this have already been described.

From the expansion chamber device 67, the exhaust system 26 further includes a tail pipe portion 68 that extends rearwardly and which crosses over at the back of the engine 23 for entry into a water trap device 69 that extends along one side of the rear of the watercraft on the side adjacent the jet propulsion unit 31. The water trap device 69 in addition to protecting against water entering the engine 23 through the exhaust system 26 also serves the function of providing an additional expansion chamber for exhaust silencing.

A trap section 71 having an inlet part 72 that extends upwardly across the top of the tunnel 32 delivers the exhaust gases to a discharge end 73. This discharge end 73 opens the atmosphere, for example, through the transom of the watercraft hull 12.

Finally, the watercraft includes a fuel tank 74 that is disposed in the engine compartment forwardly of the engine 23 for supplying fuel to its fuel charging system, which may be any known or suitable type.

Figure 6:
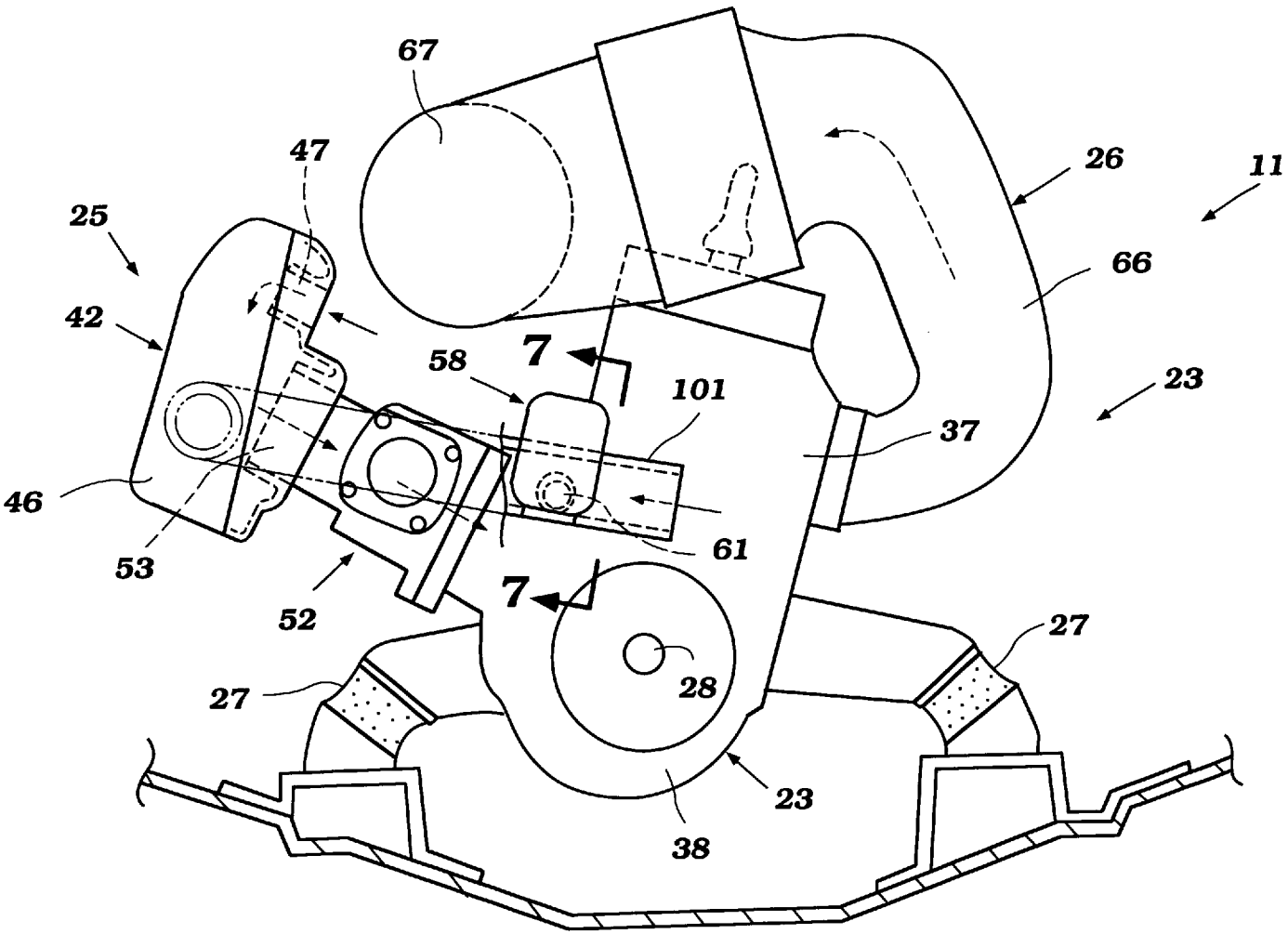
FIG. 6 is a view in part similar to FIG. 2, but looking in the opposite direction thereof and showing a second embodiment of the invention.
Figure 7:
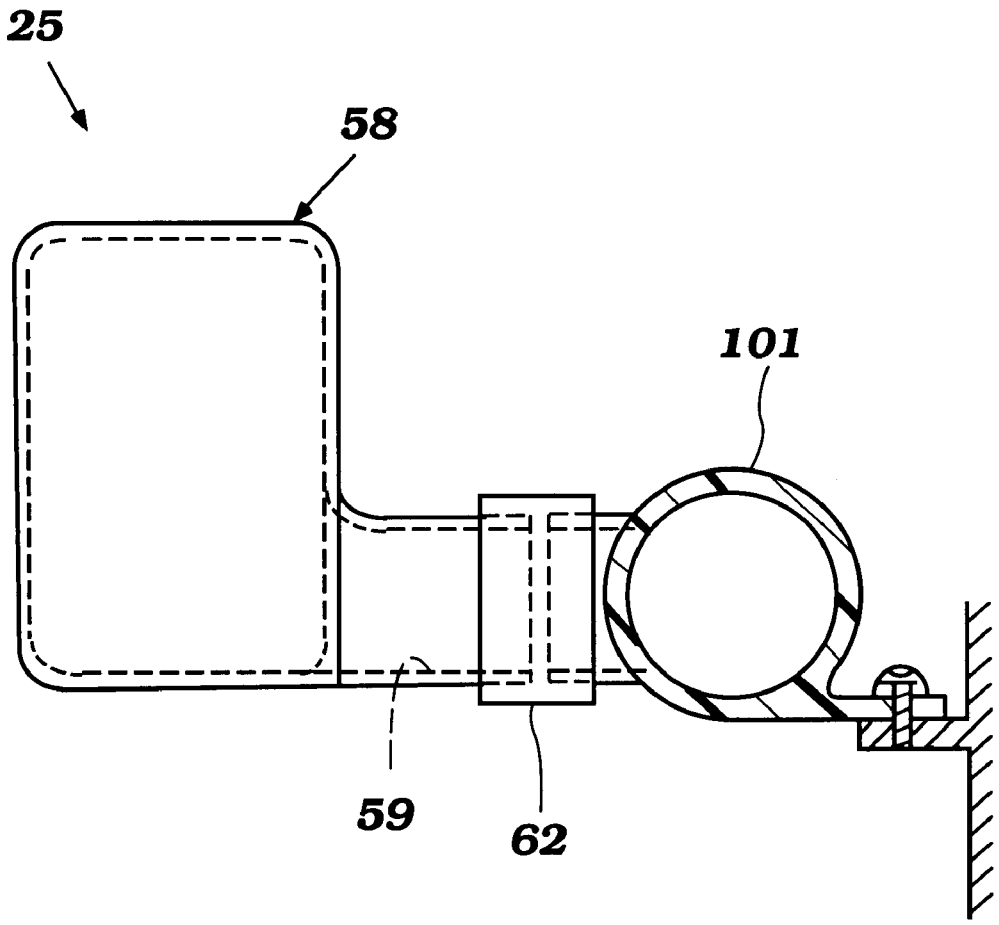
FIG. 7 is an enlarged view taken along the line 7—7 of FIG. 6.

FIGS. 6 and 7 show another embodiment which is generally the same as the embodiment of FIGS. 1–5. Where components of this embodiment are the same as those from the previously described embodiment, they have been identified by the same reference numeral and will not be described again, except insofar as is necessary to understand the construction and operation of this embodiment.

In this embodiment, an inlet tube 101 is provided that delivers air to one side of the housing 42. Although a single inlet can be provided at either end, it is also possible to use two inlet devices 101, one at each end of the engine and at each end of the housing 42. The inlet tubes 101 are inclined downwardly so collected water will tend to drain back out of them rather than accumulate in them.

Also, in this embodiment, a supplemental plenum chamber device 58 is connected to the inlet tube 101 at a point spaced along its length through a connecting opening 61. Thus, these devices also act like Helmholtz resonators having an interconnecting tube whose length is either equal to the length of the tube 61 or the length of the tube 61 combined with the distance between the connection of the tube 61 to the tube 101 and the connection of the tube 61 to the chamber 46 of the intake device 42. Also, by providing the supplemental intake pipes 101 in addition to the normal intake pipes 47, still greater amounts of air can be inducted.

Figure 8:
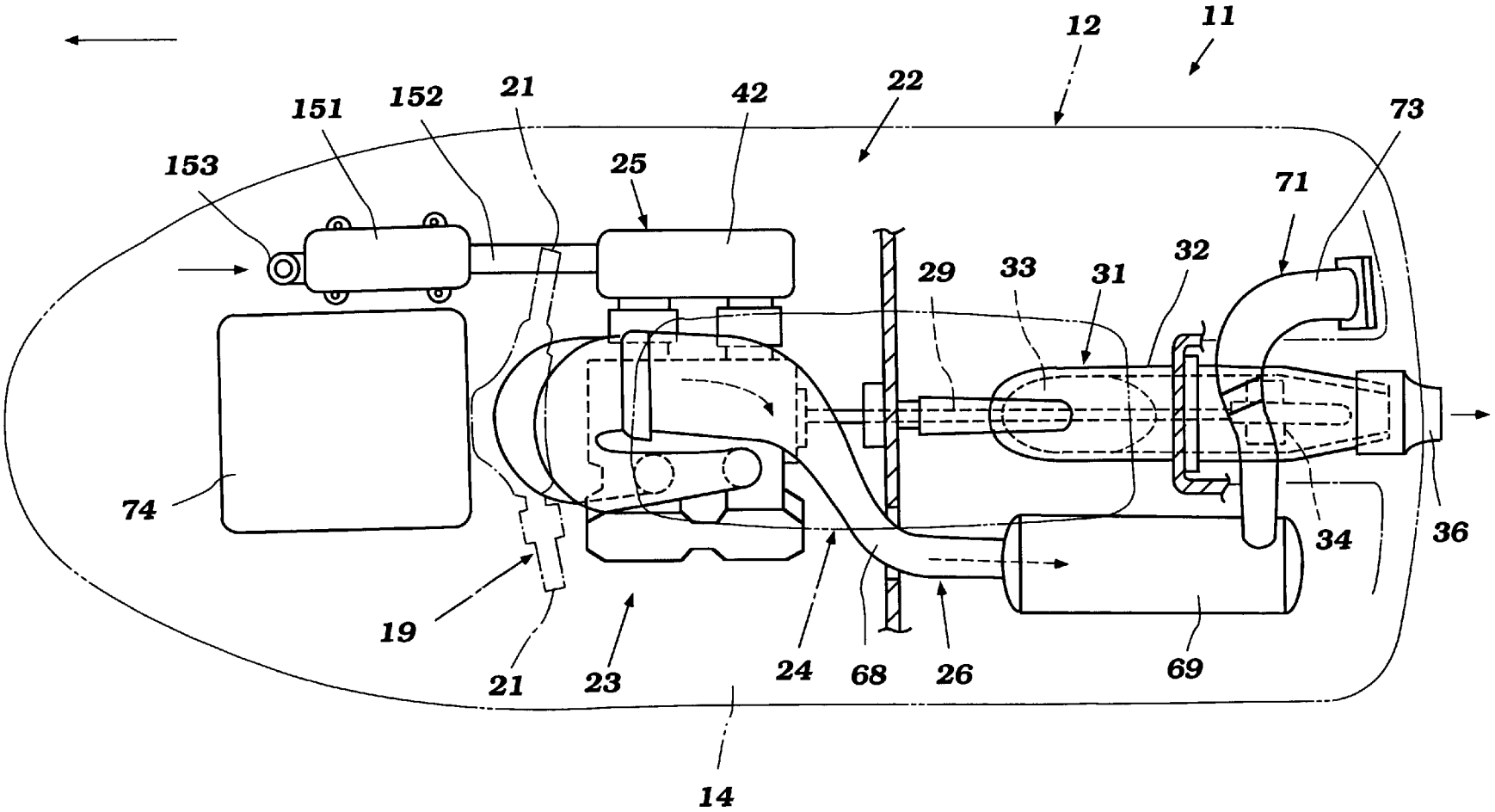
FIG. 8 is a top plan view, in part similar to FIG. 1 and shows a further embodiment of the invention.

FIG. 8 shows yet another embodiment of the invention. In this embodiment, there is provided a supplemental expansion chamber indicated by the reference numeral 151 which is at the forward end of the engine and which is connected to the inlet device 25 by means of an elongated tube 152. The intake device 25 may be of the type as shown in FIGS. 1–5 with or without the supplemental additional plenum chamber devices.

The supplemental plenum chamber device 151 is provided with an inlet 153 that opens into a forward portion of the engine compartment and one which is preferably forwardly of the forward vent opening so as to further ensure against the ingestion of water.

Figure 9:
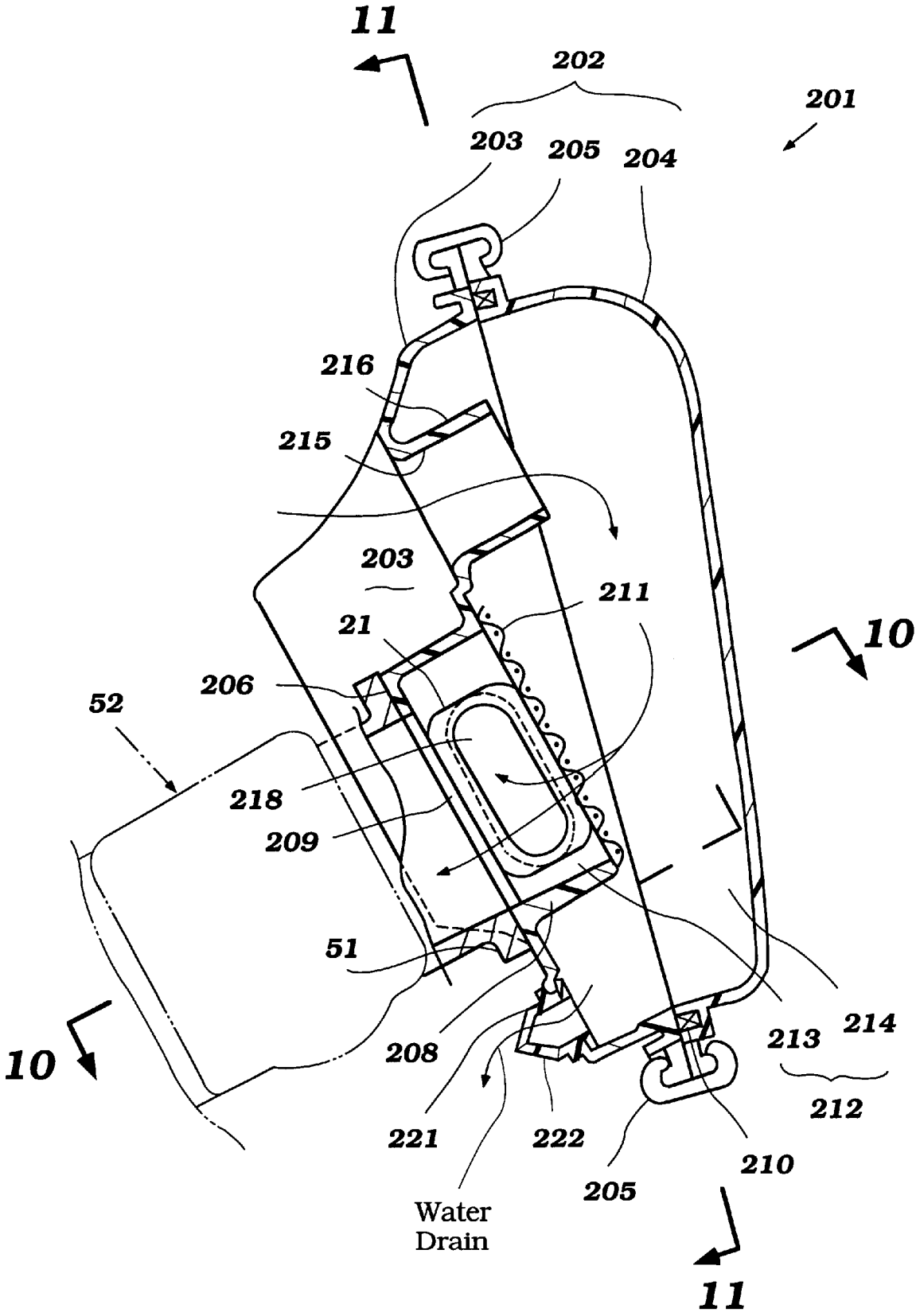
FIG. 9 is a cross-sectional view, in part similar to FIG. 4, and shows another embodiment of the invention.
Figure 10:
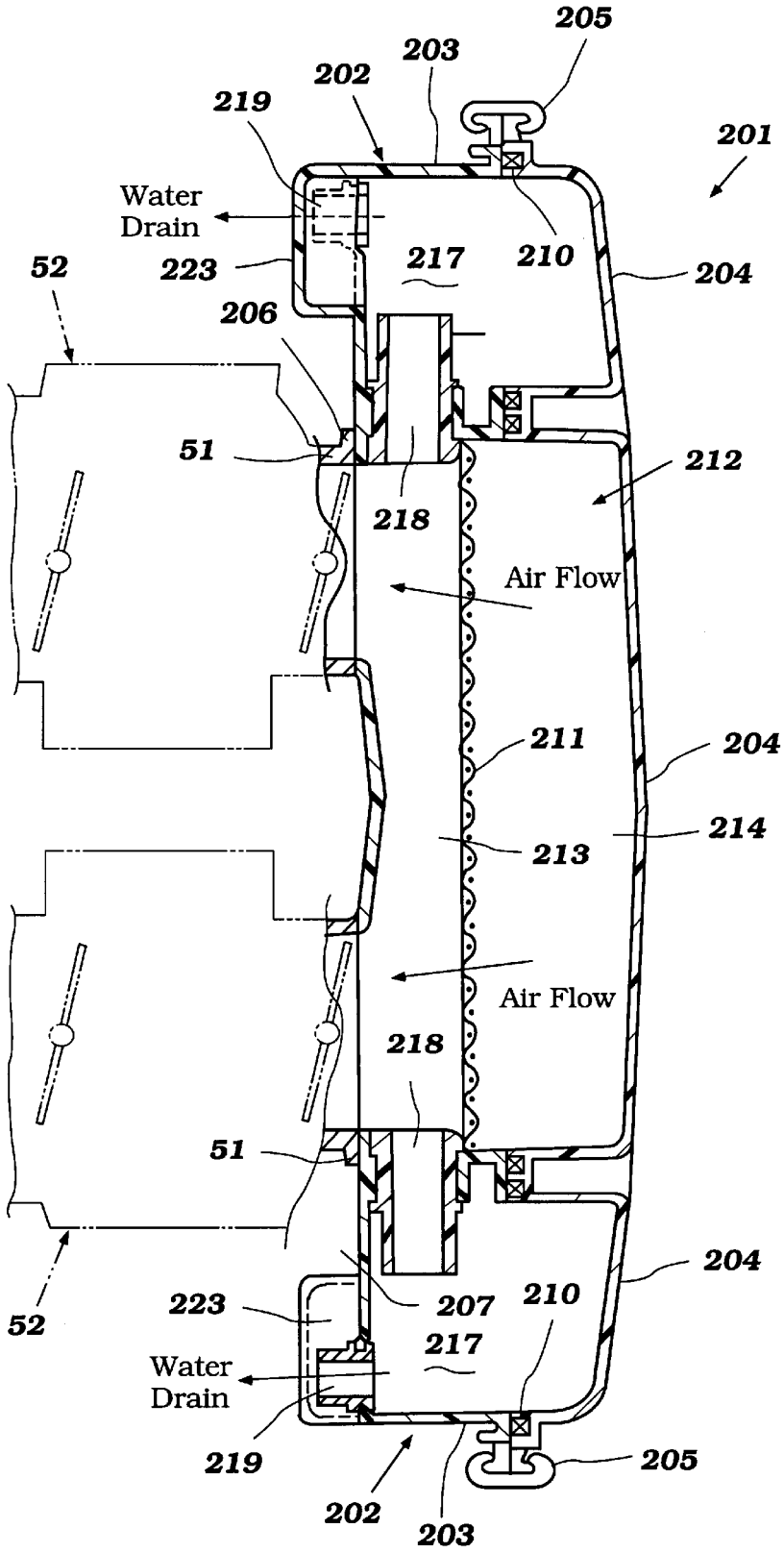
FIG. 10 is a cross-sectional view taken along the line 10—10 of FIG. 9.
Figure 11:
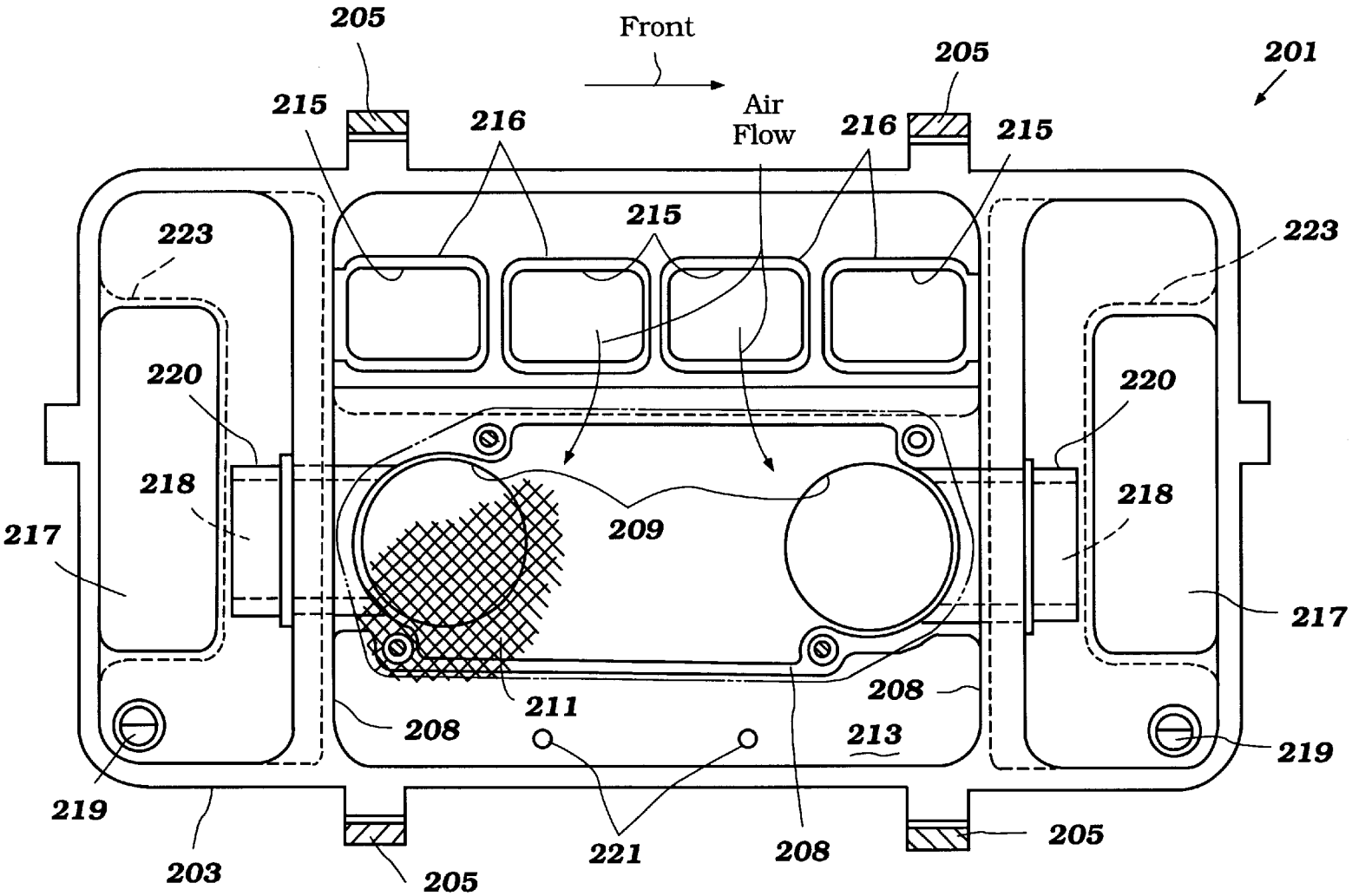
FIG. 11 is a cross-sectional view taken along the line 11—11 of FIG. 9.

FIGS. 9–11 show another embodiment of air inlet device which is generally similar to the device shown in FIGS. 4 and 5 but in many ways is simpler and more compact and yet achieves the results as aforenoted. This inlet device is identified generally by the reference numeral 201 and is mounted on the associated engine in the same orientation and in the same relation to the associated watercraft and other engine components as shown in FIGS. 1–3.

The air inlet device 201 is comprised of an outer housing assembly, indicated generally by the reference numeral 202 that is comprised of a pair of mating sections 203 and 204 that have peripheral flanges that are affixed to each other by clamping elements 205. In this embodiment, the housing pieces 203 and 204 may be formed from a suitable nonmetallic material such as a molded fiberglass material or the like. A seal 210 is provided at the mating surfaces of the sections 203 and 204 to insure against leakage in this area.

The housing piece 203 is provided with a face 206 that is fixed in mating relationship with the throttle body flanges 51 in a suitable manner. This face 206 is formed in part by an indented section 207 which is formed primarily by a peripheral wall 208 and which has at its lower end openings 209 that register with the inlet openings of the throttle bodies 52. A screen 211 is affixed to the upper ends of the walls 208 and filters coarse particles from entering into the throttle bodies 52.

The housing pieces 203 and 204 define a plenum chamber of a fixed volume, indicated generally by the reference numeral 212 and which is formed by parts 213 and 214 formed by the housing pieces 203 and 204, respectively.

Spaced vertically upwardly from the indented portion 207 of the housing piece 203, there are formed a plurality of atmospheric air inlet openings 215 which have relatively short tuning necks 216 that extend into the plenum volume 212. These openings 215, like the openings 47 of the embodiment of FIGS. 1–5 face generally downwardly and toward the main engine body so as to be protected from the ingress of water which may be present in the engine compartment of the associated watercraft.

As may be best seen in FIGS. 10 and 11, the housing pieces 203 and 204 further define auxiliary fixed volume plenum chambers 217 that extend generally vertically along opposite sides of the main plenum volume 212. These smaller plenum volumes 217 each communicate with the outlet portions of the inlet device 201 through tuning necks 218 that extend into the chambers 217. These tuning necks are formed by insert pieces 220 that are mounted in the peripheral wall 208 of the projection 207 of the housing piece 213. These volumes 217 and the length of the tuning necks 218 are chosen so as to provide the desired degree of induction system silencing and function, like the other embodiments, as Helmholtz resonators.

At the lower end of the auxiliary silencing plenum volumes 217, there are provided water drainage openings 219 which may have, if desired, duck bill type check valves mounted thereon. Because the plenum chambers 218 serve primarily silencing functions, such duck bill check valves may not be required for these openings but may be utilized, if desired.

In addition, the housing member 203 is formed with a pair of openings 221 at opposite sides thereof and at their lower peripheral ends as best seen in FIGS. 9 and 11. Duck bill type check valves 222 are provided in these openings 221 so that water may drain from them but so that air cannot enter through these openings.

To provide sufficient volume for the plenum chambers 217, their volume may be increased by providing embossments 223 in the areas above the drain openings 219. These embossments 223 can increase the volume of the chambers 217 if desired and do not add to the overall size of the assembly because they nest adjacent the throttle bodies 52. Thus, this embodiment provides not only a very simple and compact arrangement but one that will provide very effective silencing for the intake air.

Thus, from the foregoing description, it should be readily apparent that the described embodiments of the invention provide very effective intake systems that will provide not only augmented silencing for the intake air, but also which provide acoustical devices that can improve the air induction under a wider range of engine running speeds and loads. Of course, those embodiments illustrated and described are just typical of those which can be utilized with the invention and various changes and modifications may be made without departing from the spirit and scope of the invention, as defined by the appended claims.

What is claimed is:

1. A watercraft comprised of a hull defining an engine compartment, an internal combustion engine having at least one combustion chamber supported within said engine compartment, a propulsion device supported by said hull and driven by said engine for propelling said hull, said engine comprising an induction system comprising means defining a plenum chamber of a first predetermined volume, an atmospheric air intake to said plenum chamber having an inlet opening for drawing air from within said engine compartment, and an outlet opening communicating with said plenum chamber for delivering the drawn air directly to said plenum chamber, a second chamber having a predetermined volume, and communicating means for communicating said second chamber with said plenum chamber.

2. A watercraft is set forth in claim 1, wherein the second chamber communicates with the plenum chamber independently of the atmospheric air inlet.

3. A watercraft as set forth in claim 2, wherein the second chamber communicates with the plenum chamber through a tuning tube to function as a Helmholtz resonator.

4. A watercraft as set forth in claim 2, wherein there are a pair of second chambers, each communicating with the plenum chamber.

5. A watercraft as set forth in claim 4, wherein each of the second chambers communicates with the plenum chamber through a respective tuning tube to function as Helmholtz resonators.

6. A watercraft as set forth in claim 5, wherein the induction system comprises an inlet device being comprised of an outer housing defining the plenum chamber, said plenum chamber having at least one outlet opening adapted to be attached in registry with an intake system for delivering a charge from said plenum chamber to the engine, said outer housing of said inlet device forming the inlet opening for delivering an air charge to said plenum chamber, and said second chambers being formed at least in part by said outer housing.

7. A watercraft as set forth in claim 1, wherein the second chamber communicates with the plenum chamber through the atmospheric air inlet.

8. A watercraft as set forth in claim 7, wherein the second chamber communicates with the plenum chamber through a tuning tube to function as a Helmholtz resonator.

9. A watercraft as set forth in claim 7, wherein the flow to the engine passes in series fashion through the chambers.

10. A watercraft as set forth in claim 9, wherein the second chamber is upstream of the plenum chamber.

11. A watercraft as set forth in claim 1, wherein the engine further has an exhaust system with a portion extending in confronting relation to the atmospheric air intake inlet opening for protecting against water ingestion.

12. A watercraft is set forth in claim 11, wherein the second chamber communicates with the plenum volume independently of the atmospheric air inlet.

13. A watercraft as set forth in claim 12, wherein the second chamber communicates with the plenum chamber through a tuning tube to function as a Helmholtz resonator.

14. A watercraft as set forth in claim 12, wherein there are a pair of second chambers, each communicating with the plenum chamber.

15. A watercraft as set forth in claim 14, wherein each of the second chambers communicates with the plenum chamber through a respective tuning tube to function as Helmholtz resonators.

16. A watercraft as set forth in claim 11, wherein the second chamber communicates with the plenum chamber through the atmospheric air inlet.

17. A watercraft as set forth in claim 16, wherein the second chamber communicates with the plenum chamber through a tuning tube to function as a Helmholtz resonator.

18. A watercraft as set forth in claims 17, wherein the flow to the engine passes in series fashion through the chambers.

19. A watercraft as set forth in claims 18, wherein the second chamber is upstream of the plenum chamber.

20. An inlet device for direct attachment to a mating part of an induction system of a personal watercraft engine, said inlet device being comprised of an outer housing defining a main plenum chamber, said main plenum chamber having at least one outlet opening associated with an attachment arrangement adapted to be attached in registry with an intake system of the associated personal watercraft engine for delivering a charge from said main plenum chamber to said engine intake system, at least one atmospheric air inlet opening formed in said outer housing of said inlet device for delivering an air charge to said main plenum chamber, and an auxiliary plenum chamber formed at least in part by said outer housing and communicating with said main plenum chamber through a tuning neck.

21. An inlet device as set forth in claim 20, wherein there are a pair of auxiliary plenum chambers formed at least in part by the outer housing, each communicating with the main plenum chamber.

22. An inlet device as set forth in claim 21, wherein each of the auxiliary plenum chambers communicate with the main plenum chamber through a respective tuning neck.

23. An inlet device as set forth in claim 20, wherein the outer housing is comprised of a pair of main housing pieces fixed together along mating surfaces and together forming the main plenum chamber.

24. An inlet device as set forth in claim 23, wherein one of the main housing pieces forms both the atmospheric air inlet opening and the outlet opening.

25. An inlet device as set forth in claim 24, wherein both the atmospheric air inlet opening and the outlet opening face in the same direction.

26. An inlet device as set forth in claim 25, wherein the outlet opening is positioned vertically below the atmospheric air inlet opening.

27. An inlet device as set forth in claim 26, wherein the atmospheric air inlet opening faces and is protected by the associated watercraft engine.

28. An inlet device as set forth in claim 23, wherein the pair of main housing pieces both form the auxiliary plenum chamber.

29. An inlet device as set forth in claim 28, wherein there are a pair of auxiliary plenum chambers each formed by the pair of main housing pieces and each of which communicates with the main plenum chamber.

30. An inlet device as set forth in claim 29, wherein each of the auxiliary plenum chambers communicate with the main plenum chamber through respective tuning necks.

31. An inlet device as set forth in claim 30, wherein the auxiliary plenum chambers are on opposite sides of the main plenum chamber.

32. An inlet device as set forth in claim 31, wherein one of the main housing pieces forms both the atmospheric air inlet opening and the outlet opening.

33. An inlet device as set forth in claim 32, wherein both the atmospheric air inlet opening and the outlet opening face in the same direction.

34. An inlet device as set forth in claim 33, wherein the outlet opening is positioned vertically below the atmospheric air inlet opening.

35. An inlet device as set forth in claim 34, wherein the atmospheric air inlet opening faces and is protected by the associated watercraft engine.

36. An inlet device as set forth in claim 35, wherein there are a plurality of atmospheric air inlet openings and outlet openings.

37. An inlet device as set forth in claim 36, wherein there are more atmospheric air inlet openings than outlet openings.

* * * * *